United States Patent [19]

Ou

[11] Patent Number: 4,679,395

[45] Date of Patent: Jul. 14, 1987

[54] CLEANING MEANS FOR VEHICLE EXHAUSTING PIPE

[76] Inventor: A- Lin Ou, No. 27, Wen Hue Road, Chung Yan Li, Chung Li City, Taiwan

[21] Appl. No.: 664,606

[22] Filed: Oct. 25, 1984

[51] Int. Cl.[4] ..... F01N 1/14; F01N 3/30

[52] U.S. Cl. ..... 60/319; 181/263; 417/159

[58] Field of Search ..... 60/316, 317, 319; 181/262, 263, 281; 417/159

[56] References Cited

U.S. PATENT DOCUMENTS

| | | | |
|---|---|---|---|
| 1,020,163 | 3/1912 | Swain | 181/281 |
| 1,864,915 | 6/1932 | Kosterman | 181/262 |
| 2,037,692 | 4/1936 | Barr | 181/262 |
| 2,169,658 | 8/1939 | Newton | 181/263 |
| 2,180,259 | 11/1939 | Sargent | 417/159 |
| 2,285,674 | 6/1942 | Merett | 181/262 |
| 3,657,878 | 4/1972 | Kaufmann | 60/319 |
| 3,875,745 | 4/1975 | Franklin | 60/319 |

*Primary Examiner*—Douglas Hart

[57] ABSTRACT

A device which comprises an intake for extraneous air to which can be admixed the waste gas emanating from exhausting pipe in an accelerating cylinder to provide additional energy to drive a vehicle, to provide a noise-muffler function, and to dilute the carbon monoxide (CO) in the waste gas.

13 Claims, 3 Drawing Figures

CLEANING MEANS FOR VEHICLE EXHAUSTING PIPE

BACKGROUND OF THE INVENTION

Today's transportation means not only can shorten the time required to traverse the distance between two places, but also can contribute to increase friendship among people by allowing more frequent unscheduled visiting. The various transportation-related industries can make the economy prosperous. Apparently, the automobile and other similarly powered transportation means been indispensable to our daily life; however, the current automobiles do have some problems such as low efficiency, high noise, and generation of exhaust gases. These problems can lead to loss of energy, and may well contribute to hazards to peoples' health. All the aforesaid problems have to be solved urgently for our today's civilized society. Therefore, the inventor has developed "A Cleaning Means for Vehicle Exhausting Pipe".

SUMMARY OF THE INVENTION

This invention provides a cleaning or purification means for vehicle exhausting pipe. The primary features of the means according to the invention reside therein that it can convert the waste and incompletely combusted gases which are being exhausted into an additional driving force by means of its particular multilayer structure for a vehicle, to reduce the noise, and to dilute the carbon monoxide (CO).

DETAILED DESCRIPTION

Figure 1:
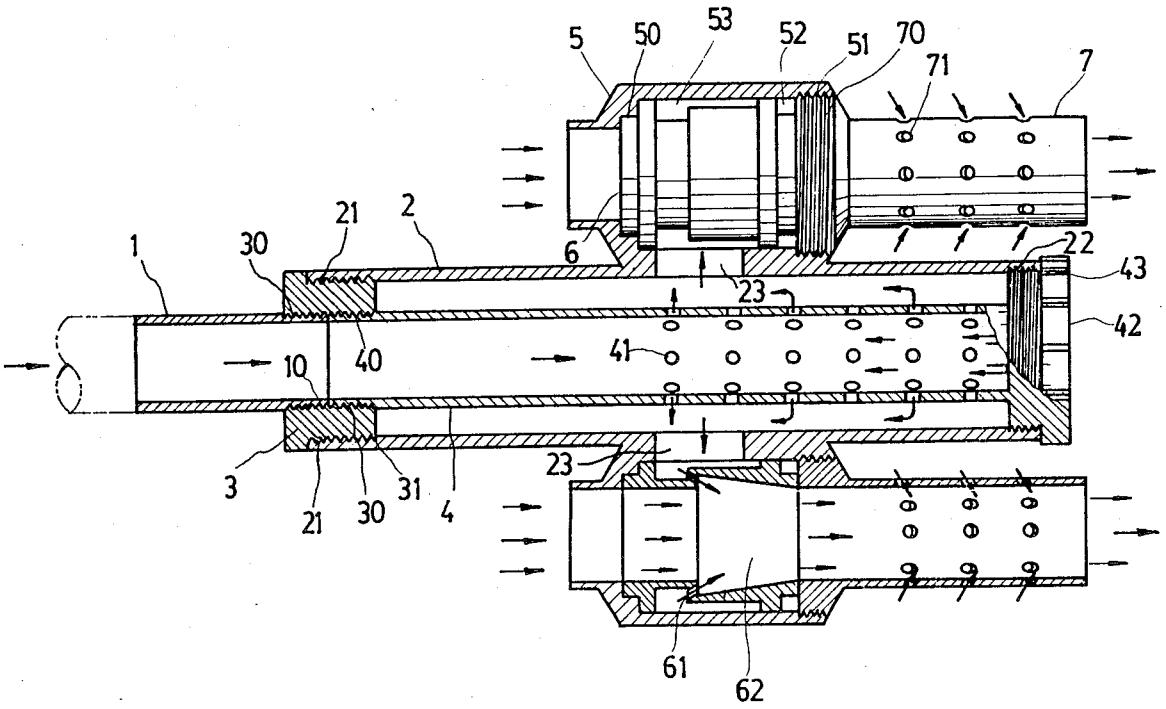
FIG. 1 is a transverse cross-sectional view of one embodiment of the present invention.

Referring to FIG. 1, there is shown a top plan view of one embodiment of the present invention, in which the tail end of the exhausting pipe 1 is furnished with outer screw threads 10, and the main sleeve 2 is furnished with inner screw threads 21 and 22 on the front end and tail end respectively. A main sleeve 2 having air outlets 23 on both sides in its central portion is attached to the exhausting pipe 1 by means of a spigot joint 3, which is a hollow short cylinder with inner screw threads 30 and outer screw threads 31. The inner screw threads 30 are screwed together with the outer screw threads 10 of the exhausting pipe 1, while the outer screw threads 31 are screwed together with the inner screw threads 21 of the main sleeve 2, i.e., the main sleeve 2 is fixedly attached to the tail portion of exhausting pipe 1 by means of the spigot joint 3. After the muffler 1, there is connected the exhausting pipe tail 4, which has outer screw threads 40, and also has the same inner diameter as the exhausting pipe 1, and of which the rear half portion is provided with a plurality of exhausting holes 41.

At the tail end of the exhausting pipe tail 4, there is attached a gas plug member 42, which is furnished with a number of straight grooves or passages on the end, and also a number of outer screw threads 43 on its front end. The outer screw threads 40 of the front end of the exhausting pipe tail 4 are screwed together with the inner screw threads 30 of the spigot joint 3, while the rear screw threads (i.e., the outer screw threads 43 of the front end of gas plug member 42) are screwed together with the inner screw threads 22 of the main sleeve 2.

On the outlets 23 on the both sides of the main sleeve 2, there are mounted two auxiliary pipes 5, respectively. Each auxiliary pipe 5 is integrally formed with the main sleeve 2, and each comprises a cascade-shaped pipe having different outer diameters, of which the front or intake end has smaller diameter. The tail end of each auxiliary pipe 5 is furnished with inner screw threads 51.

Inside an auxiliary pipe 5, there is typically furnished an acceleration cylinder 6 which is furnished with two cylindrical flanges, respectively one at each of its two ends, to slidingly contact the inner wall of the acceleration cylinder chamber 52 in the auxiliary pipe 5.

The space between the two cylindrical flanges establishes a sealed chamber 53. In and through the shoulder of one portion of the acceleration cyliner 6, there is provided a number of jetting holes 61. The inner surface of the front end of the acceleration cylinder 6 is aligned with or seated at the inner surface of the auxiliary pipe 5. At the central portion of the acceleration cylinder 6, the inner diameter is increased to provide the mentioned shoulder portion in which is arranged a number of the mentioned jetting holes 61, and then the inner diameter is reduced gradually forming a converging nozzle 62. The inner diameter of the tail portion of auxiliary pipe extender 7 is the same as that of the converging nozzle 62. The outer screw threads 70 of the tail portion of auxiliary pipe extender 7 are screwed together with the inner screw threads 51 of the auxiliary pipe 5. The tail portion of the auxiliary pipe extender or muffler 7 is furnished with a number of accelerating holes 71.

Referring to FIG. 1, there is shown a number of arrows, which indicate a small part of gas being exhausted through the exhausting holes 41 in the exhausting pipe tail 4, and most of the gas striking upon the gas plug member 42 and then passing through the exhausting holes 41 and thence the outlets 23 and into the sealed chamber 53 of the auxiliary pipe 5. Then the gas is compressed through the jetting holes 61 in the accelerating cylinder 6 to enter into the converging nozzle 62.

When the automobile is moving, a substantial amount of air will enter into the auxiliary pipe 5 from the front opening thereof and as a result of the relative velocity will mix with the high pressure carbon monoxide (CO). Then the mixed gas is exhausted out through the converging nozzle 62 at a high speed as a result of the converging walls of the nozzle 62. Under Bernoulli's Equation, the pressure difference between the two sides communicated by the jetting holes 61 is increased substantially so as to have the gas in the sealed chamber 53 driven into the converging nozzle 62 with considerable force to mix with air before being exhausted out of the tail portion of auxiliary pipe 7. Bernoulii's Equation is shown as follows:

$$\frac{U^2}{2g}\text{ (Motion Energy)} + \frac{P}{\rho}\text{ (Pressure Energy)} + gZ\text{ (Potential Energy)} = E\text{ (Total Energy)} = \text{Constant.}$$

According to the aforesaid "Equation", the incomplete combustion gas (gas which has been incompletely combusted by the respective engine) having motion energy is exhausted through the exhausting pipe 1, and is rebounded upon hitting the gas plug member 42. At that moment, its motion energy is reduced, while a pressure energy is generated, and then the gas passes through the outlet or passage 23 to enter into the sealed chamber 53. Simultaneously, a substantial amount of air having high motion energy as a result of relative velocity will flow into the acceleration cylinder 6. The pressure in the acceleration cylinder 6 is then much lower than that in the sealed chamber 53, i.e. the pressure in the sealed chamber 53 becomes a driving force to compress the incomplete combustion gas at high speed through the small jetting holes 61 and into the acceleration cylinder 6 for mixing with the air having high motion energy as a result of relative velocity. After passing through the converging nozzle 62, the mixed gas has even greater motion energy. Moreover, the air pressure around the tail portion of muffler 7 is also higher than that of the mixed gas inside the muffler 7. Consequently, the air outside the muffler 7 would flow into the tail portion 7 through the accelerating holes 71 to be mixed with the mixed gas in the muffler 7 before being exhausted therefrom.

Summing up the aforesaid discussion, it is apparent that the incomplete combustion gas (CO) exhausted out of the exhausting pipe 1 will generate a higher pressure and speed and will be admixed to a considerable amount of air. The resultant mixed gas will be exhausted out of the tail portion of the auxiliary pipe 7 with high speed.

According to Newton's Third Law, when one body exerts a force on another body, the other body will generate a force that is equal to the force of the first body, but is in opposite direction to the first force. By the same token, the gas exhausted out of the exhausting pipe 1 will pass through a pressure-increasing step to generate a driving force to assist with the forward motion of the vehicle or automobile.

Thus, the present invention may be deemed as including the feature of saving fuel. Further, the incomplete combustion gas (CO) can absorb oxygen ($O_2$) in the human body to convert it into $CO_2$, according to the equation $CO+(\frac{1}{2})O_2 \rightarrow CO_2$. This can cause serious harm to the human body. In the present invention, the aforesaid CO will be mixed with great quantities of air, i.e. the "CO" is diluted in every unit of volume, and this leads to a reduction of the density of "CO" that may be absorbed into the human body.

The gas exhausted out from the exhausting pipe 1 will, upon being treated in accordance with the device of the present invention, be repeatedly compressed and expanded. As a result, the noise usually caused by or at the exhausting pipe will also be reduced with the present invention. Since all the parts in the present invention, such as the main sleeve 2, the exhausting pipe tail 4, the gas plug member 42, the acceleration cylinder 6, and the tail portion of the auxiliary pipe extender 7, etc. are detachable for cleaning purposes, the serviceable life thereof and of the exhausting pipe 1 will be increased.

Figure 2:
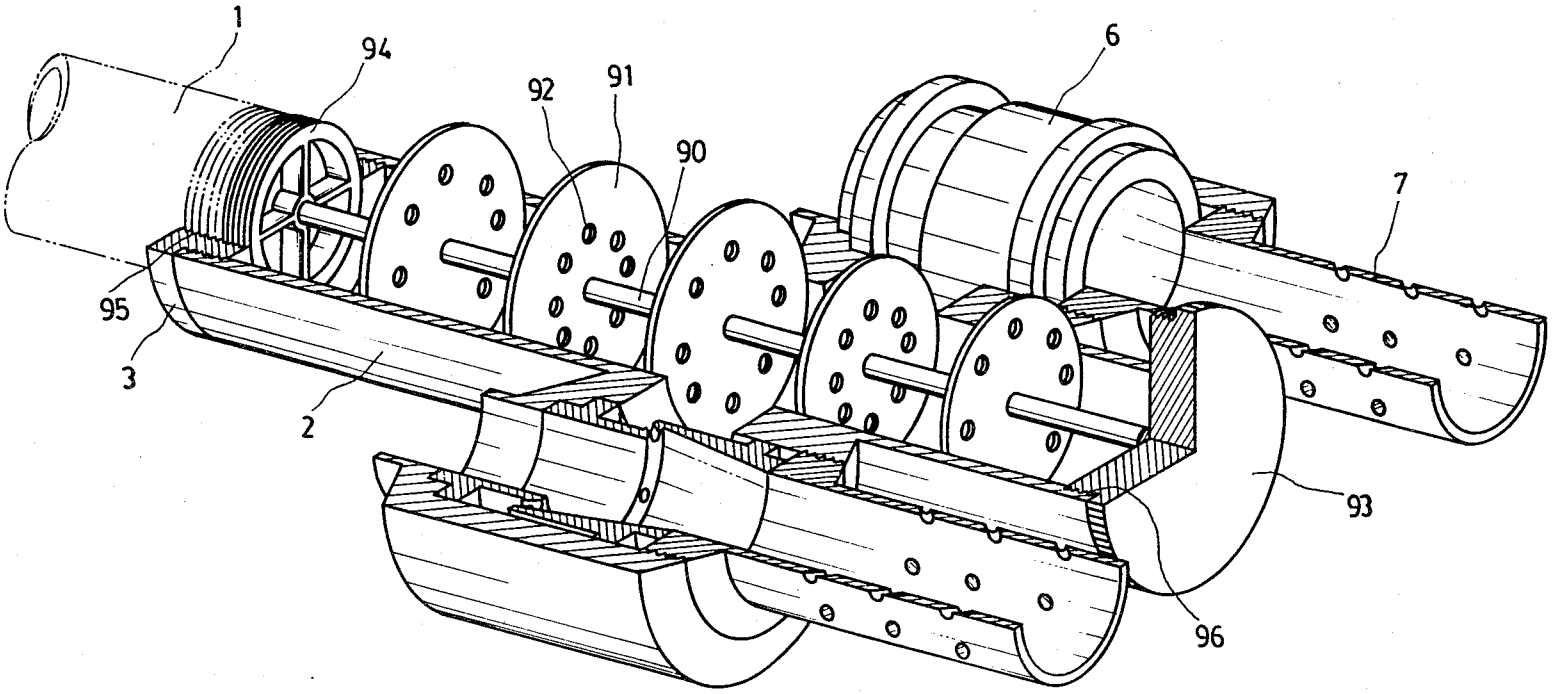
FIG. 2 is a perspective view of a second embodiment of the present invention.

Referring to FIG. 2, there is shown a further embodiment of the present invention, in which the exhausting pipe tail 9 includes a connecting rod 90 on which is mounted a plurality of regularly spaced ventilation discs 91. The outer diameter of the ventilation discs may not be identical; for example, the diameter of those ventilation discs 91 situated in front of an outlet 23 is adapted to fit in the main sleeve 2, while the diameter of those ventilation discs 91 behind the outlet 23 is smaller than the inner diameter of the main sleeve 2. Moreover, each of the ventilation discs 91 is furnished with a plurality of ventilation holes 92; however, some of the ventilation discs 91 have their ventilation holes 92 arranged near their outer circumference, while each of their adjacent ventilation discs 91 has its ventilation holes 92 arranged near the center of the disc 91. One end of the connecting rod 90 is positioned a recess in in the gas plug member 93, while the other end is movably positioned in the center hole of the positioning wheel 94 of connecting rod 90. The screw threads 95 on the outer circumferential wall of the positioning wheel 94 are screwed together with the inner screw threads 30 spigot joint 3. The plug member disc 93 also has outer screw threads 96 on its outer circumference so as to be screwed together with the inner screw threads 30 of spigot joint 3.

In operation, the waste gas exhausted through and out of the exhausting pipe 1 will pass through the ventilation holes 92 in the ventilation discs 91 for compression and expansion between two adjacent ventilation discs 91 so as to be subjected to the action of a muffler. When the waste gas hits the gas plug member 93 and is rebounded therefrom, the waste gas will again pass through the respective ventilation disc 91, the main sleeve 2, and thence through the outlet 23 to enter into the sealed chamber 53. Simultaneously, large quantities of air with high motion energy are introduced, as a result of relative velocity flows, into the acceleration cylinder 6. Consequently, the pressure inside the acceleration cylinder 6 is much lower than that in the sealed chamber 53, and the pressure in the sealed chamber 53 provides a driving force to compress the incomplete combustion gas and to cause it to pass through the small jetting holes 61 (best seen in FIG. 1). In the acceleration cylinder 6 the incompletely combusted gas is mixed having the air with high motion energy due to the relative velocity. The resultant mixed gas will pass through the converging nozzle 62 to generate a mixed air with yet higher motion energy. Since the air pressure outside the tail portion of auxiliary pipe 7 is higher than that of the mixed air inside the tail portion 7 the air outside the tail portion 7 will, through the accelerating holes 71, flow into the tail portion 7 to further mix with the air/gas mixture therein.

Figure 3:
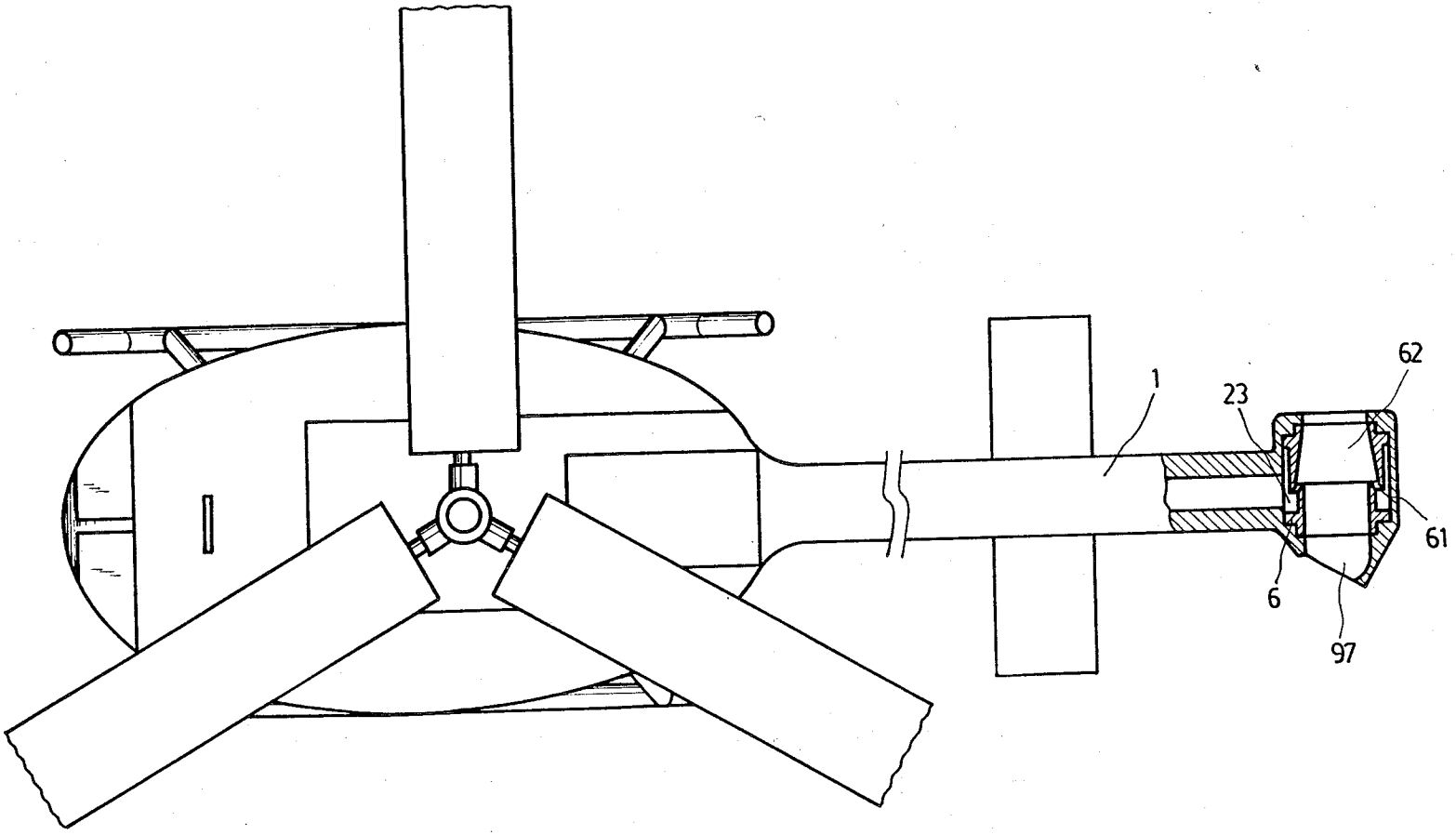
FIG. 3 is a plan view showing in partial cross section a third embodiment of the present invention.

The present invention may also be used as a tail propeller for a helicopter as is generally shown in FIG. 3, in which the waste gas exhausted through and out of the exhausting pipe 1 will, through the outlet 23, flow directly into the acceleration cylinder 6. Next, it will flow through the jetting holes 61 and the converging nozzle 62. The tail portion of the helicopter is equipped with an elbow pipe 97, which will, when the helicopter is performing flying motions, collect large quantities of air as a result of the relative velocity. This air is passed into the acceleration cylinder 6 and through the converging nozzle 62, with the air being mixed with the waste gas passed through the jetting holes 61 to form a mixed gas that has higher speed and pressure. This mixed gas can also reduce the noise of the exhausting pipe.

Moreover, the flying direction of the helicopter may be controlled freely upon the pilot accelerating the engine.

What is claimed is:

1. In a multi-component exhaust assembly adapted to be connected at the exhausting pipe of a vehicle, including an acceleration cylinder with an air inlet terminus and an outlet terminus remote from said air inlet terminus, said acceleration cylinder comprising:

a walled housing defining a passage in said acceleration cylinder between said air inlet terminus and said outlet terminus thereof;

a hollow cylindrical body, with said hollow cylindrical body having two spaced cylindrical circumferential flanges for seating it in said housing at the walls thereof thereby forming a chamber for receiving exhaust gases from said exhausting pipe; said hollow cylindrical body defining an interior nozzle formation tapering in the direction of the outlet terminus of said acceleration cylinder and said nozzle formation being connected to said air inlet terminus for receiving atmospheric air during operation of the respective vehicle; and walled passage means for connecting said chamber for receiving exhaust gases and said interior nozzle with concomitant admixture of air during operation of the respective vehicle.

2. An exhaust assembly adapted to be secured at the exhausting pipe of a vehicle, including the acceleration cylinder of claim 1 and further comprising:

a main sleeve, said main sleeve having a first terminus for connecting it as the exhausting pipe of the respective vehicle; said main sleeve having a second terminus and at least one radially directed outlet between said first terminus and said second terminus for communicating the exhausting pipe of the respective vehicle with said chamber for receiving exhaust gases;

a gas plug member removably secured at said second terminus of said main sleeve, said gas plug member being adapted to have exhaust gases impinge on its receiving surface and reverse the direction of travel of impinging gas flow; and a hollow exhausting tail pipe adapted to be connected at the exhausting pipe, said exhausting tail pipe having a plurality of radially directed exhausting passages for communicating the exhausting pipe with the interior of said main sleeve.

3. The exhaust as claimed in claim 2 and further comprising:

an auxiliary pipe extension operatively connected at the outlet terminus of said acceleration cylinder, said auxiliary pipe extension having a plurality of radially directed passages.

4. The exhaust as defined in claim 3 wherein said radially directed passages are directionally slanted.

5. The exhaust as defined in claim 3 wherein said auxiliary pipe is connected by screw threads to said walled housing of said acceleration cylinder at the outlet terminus thereof.

6. The exhaust as defined in claim 5 and further comprising:

a spigot joint for connecting said main sleeve and said exhausting tail pipe at the first terminus of said main sleeve to the exhausting pipe of the respective vehicle.

7. The exhaust as defined in claim 6 wherein said spigot joint has interior screw threads for joining said hollow exhausting tail pipe and the exhausting pipe by means of cooperating external screw threads; and wherein said spigot joint has exterior screw threads for connecting to it the first terminus of said main sleeve.

8. The exhaust as defined in claim 2 wherein said walled housing is integrally formed with said main sleeve at least at said walled passage between said air inlet terminus and said outlet terminus.

9. The exhaust as defined in claim 1 and further comprising at least one elbow for passing air into said acceleration cylinder.

10. The exhaust as defined in claim 2 and further comprising:

a positioning wheel operatively connectable at said first terminus of said main sleeve;

a connecting rod operatively connectable with its one terminus at said positioning wheel and at said gas plug member with its other terminus;

a plurality of ventilation discs mounted in spaced relation between said positioning wheel and said gas plug member.

11. The exhaust as defined in claim 10 wherein said ventilation discs are provided with ventilation passages.

12. The exhaust as defined in claim 11 wherein said ventilation passages are arranged in a circular pattern.

13. The exhaust as defined in claim 12 wherein said ventilation passages are arranged to provide a tortuous path for exhaust gas.

* * * * *